United States Patent [19]

Clavin

[11] 4,088,007

[45] May 9, 1978

[54] PIPE BENDING MANDREL

[75] Inventor: Edward A. Clavin, Houston, Tex.

[73] Assignee: Midcon Pipeline Equipment Co., Houston, Tex.

[21] Appl. No.: 761,881

[22] Filed: Jan. 24, 1977

[51] Int. Cl.[2] ..... B21D 9/00

[52] U.S. Cl. ..... 72/466; 269/48.1

[58] Field of Search ..... 72/392, 465, 466; 269/48.1

[56] References Cited

U.S. PATENT DOCUMENTS

| | | | |
|---|---|---|---|
| 3,043,361 | 7/1962 | Kelso | 72/466 |
| 3,274,817 | 9/1966 | Anderson | 72/466 |
| 3,747,394 | 7/1963 | Cunningham | 72/466 |
| 3,964,290 | 6/1976 | Auxer | 72/466 |

*Primary Examiner*—Lowell A. Larson
*Attorney, Agent, or Firm*—Carl B. Fox, Jr.

[57] ABSTRACT

Pipe bending mandrel wherein oppositely disposed pipe wall engaging elements are connected to a drive unit at one end by toggle elements permitting inward and outward movements of the pipe wall engaging elements, and wherein said pipe wall engaging elements are connected to a longitudinal axial shaft of the drive unit by plural axially spaced toggle elements which move the pipe wall engaging elements inwardly or outwardly upon reciprocating movements of the shaft in opposite directions.

12 Claims, 4 Drawing Figures

Fig. 2
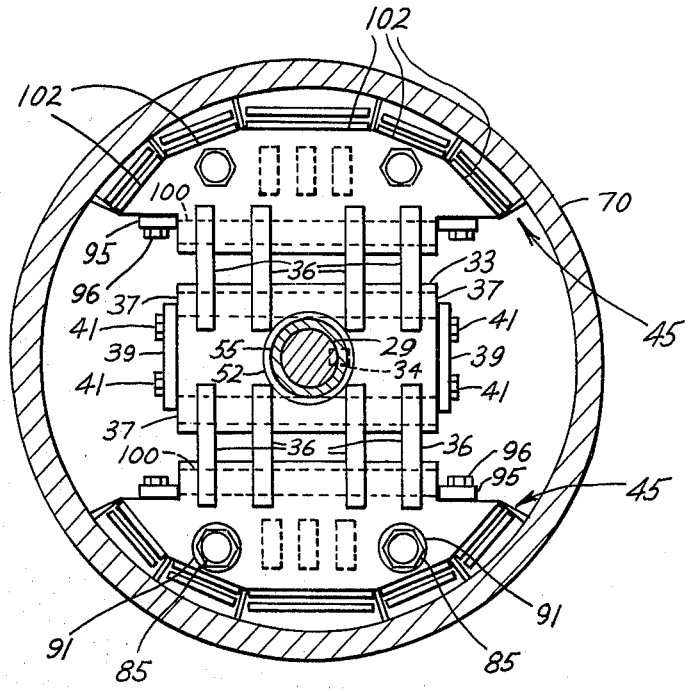
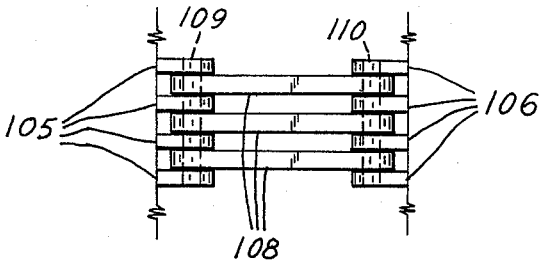
Fig. 3

PIPE BENDING MANDREL

BACKGROUND OF THE INVENTION

Pipe bending mandrels as known in the prior art are heavy and complicated apparatuses. This invention seeks to provide pipe bending mandrel apparatus which is lighter in weight and less complicated than are the prior art structures.

SUMMARY OF THE INVENTION

According to the invention, pipe bending mandrels are provided which are relatively light in weight and simple in operation. Oppositely disposed elongate pipe wall engaging elements are connected to a drive unit, supported centrally of the pipe to be bent, by plural toggle elements which permit inward and outward movements of the pipe wall engaging elements. The drive unit has an axial longitudinal shaft driven in reciprocating motion by the drive unit. The shaft is connected by plural toggle units to the pipe wall engaging elements at opposite sides thereof. The toggle units connected to the shaft drive the pipe wall engaging elements either inwardly or outwardly depending upon the direction of movement of the shaft. Wheels are provided so that the assembly may be rolled along a pipe when the pipe wall engaging elements are drawn inwardly, or retracted. The apparatus is designed to be bendable longitudinally of the pipe. With minor modifications, the apparatus may be employed in pipes of different sizes.

A principal object of the invention is to provide a pipe bending mandrel apparatus which is light in weight and simple in operation. Another object of the invention is to provide such apparatus which is capable of exerting great pipe wall supporting force. A further object of the invention is to provide such apparatus which may be used in pipes of different diameters. Yet another object of the invention is to provide such apparatus which is economical and yet which is efficient and reliable in use.

Other objects and advantages of the invention will appear from the following detailed description of preferred embodiments thereof, reference being made to the accompanying drawings.

BRIEF DESCRIPTIONS OF THE DRAWINGS

FIG. 2 is a vertical cross section taken at line 2—2 of FIG. 1.

FIG. 3 is a partial plan view taken at line 3—3 of FIG. 1.

DESCRIPTION OF THE PREFERRED EMBODIMENTS

Figure 1:
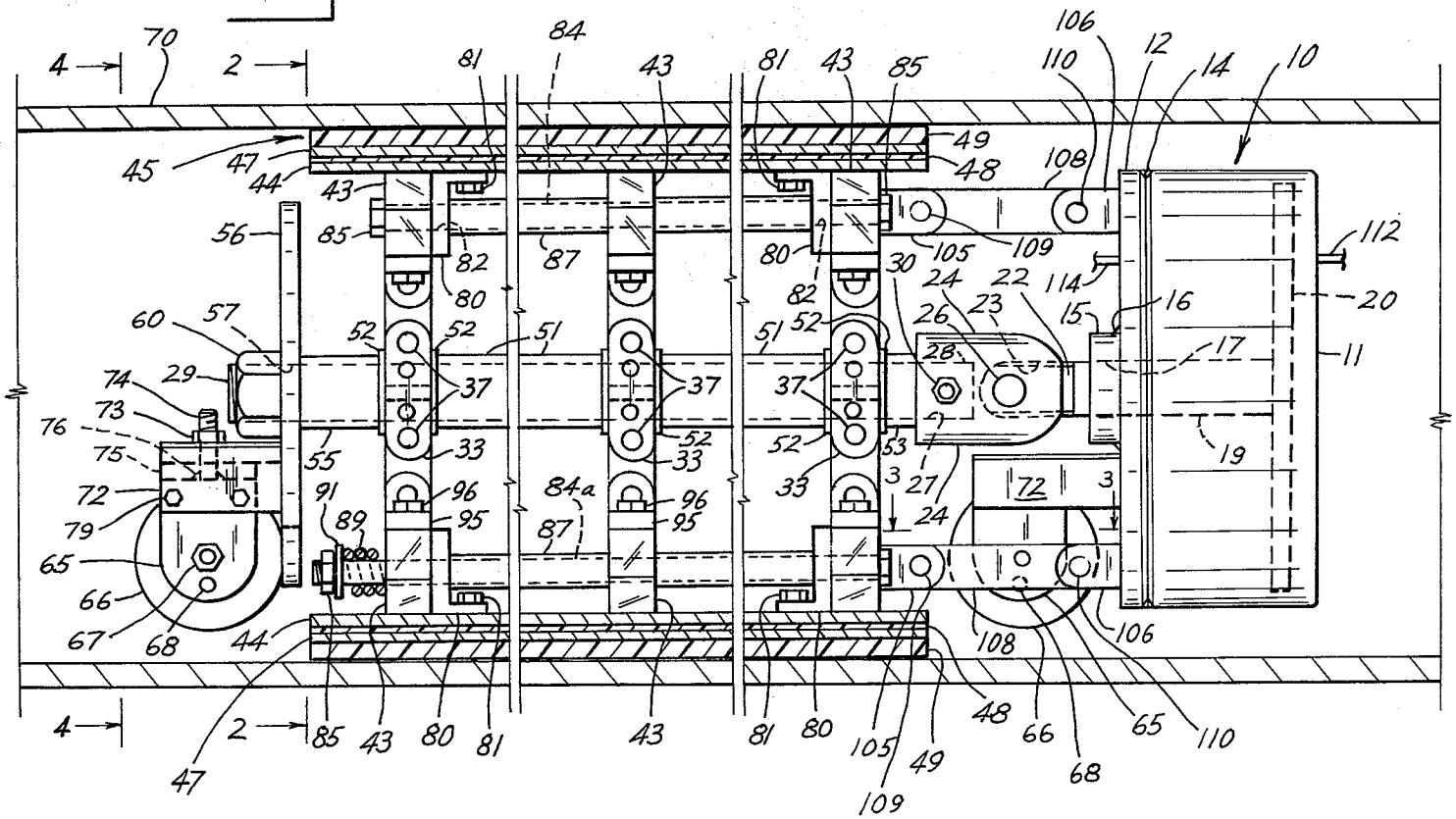
FIG. 1 is a side elevation, partly in vertical cross section, showing a preferred embodiment of apparatus according to the invention.

Describing now the preferred embodiments of apparatus as shown in the drawings, in FIG. 1 there is shown a drive unit 10. Drive unit 10 is a hydraulic or pneumatic cylinder including a hollow cylinder housing 11 and a cover 12 which is peripherally welded to housing 11 at weld 14. A hub 15 welded to cover 12 at 16 has a central opening 17 through which shaft 19 connected to piston 20 concentrically extends. Shaft 19 is relieved at opposite sides at 22, the relieved end portion extending into a slot opening 23 of a connector element 24 and connected to the connector element by transverse pin 26. This connection of shaft 19 to connector element 24 permits a slight amount of pivotal movement of the connector element.

At its opposite end, connector element 24 has a cylindrical bore 27 into which the end 28 of a shaft 29 of cylindrical shape is fitted and held in place by cross bolt 30 disposed through registered openings through connector element 24 and shaft end 28.

Shaft 29 extends through central circular openings of plural toggle connection elements 33, which may be provided in any number, three being shown. Shaft 29 is keyed to at least one of said elements 33 by one or more keys 34, shown in FIG. 2, to prevent rotation of elements 33 on shaft 29.

Referring now also to the other drawing figures, each toggle connection element 33 has plural slots 35 oppositely disposed along its upper and lower sides. Plural toggle elements 36 are connected to each toggle connection element 33 by cross pins 37. The cross pins 37 are held in place by a plate 39 at each side of each element 33, the plates 39 being secured to elements 33 by screws 41. The plates 39 are not shown in FIG. 1 so that the structures therebeneath may be more clearly seen.

At their outer ends, the toggles 36 are connected to fittings 43 which are carried by the central inner plates 44 of pipe wall engaging elements 45. Each pipe wall engaging element 45 comprises plural inner plates 44, intermediate spacer plates 47, and elastomeric layers 48, 49, elements 49 being arcuate at their outer surfaces for flush engagement with the interior of the pipe wall. The elastomeric portions 48, 49 are elastomeric as described, but are of sufficient firmness and hardness to withstand the relatively high compressive forces thereof against the pipe wall without excessive deformation.

Toggle connection elements 33 are spaced apart by spacer sleeves 51 and washers 52. A short spacer sleeve 53 and a washer 52 space connection element 24 from the first of the elements 33. A spacer sleeve 55 and washer 52 space the last of the elements 33 from a disc shaped plate 56 having a central circular opening 57 engaged around shaft 29, a terminal nut 60 being screwed onto the threaded end of shaft 29 as best shown in FIG. 1.

Figure 4:
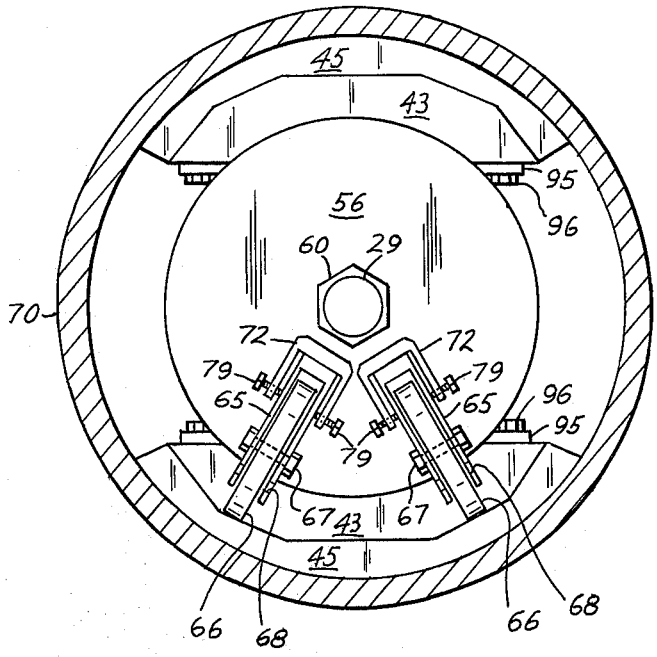
FIG. 4 is a vertical cross section taken at line 4—4 of FIG. 1.

A wheel yoke 65 has a wheel 66 supported by cross bolt 67. Bolt 67 may be moved to a second more outwardly disposed pair of holes 68 to move wheel 66 outwardly to be accommodated to a pipe of larger diameter than pipe 70. Pipe engagement elements 45 may be thickened by addition of additional spacer elements 45 to be accommodated to the pipe of larger diameter. Yoke 65 is received at its upper end into a U-shaped bracket 72 in which it is secured by nut 73 screwed onto threaded stud 74 which is welded to upper cross plate 75 of the wheel yoke at 76. As will be clear, the wheel assembly is very simple and may be removed and replaced very simply. Screws 79 screwed through tapped openings through the opposite sides of U-shaped bracket 72 may be adjusted to adjust the camber of the wheel 66, so that the wheel will track correctly when the apparatus is rolled thereon along the length of the pipe. The wheel 66 shown in FIG. 1 is shown out of its true position. At least two wheels 66 will be provided as shown in FIG. 4, preferably at angles of, for example, 30° to each side of the center. A third wheel (not shown) may be provided at the vertical center at the upper part of the apparatus, but in most cases the third wheel will not be required. Additional wheels 66 are provided mounted on cover 12 of drive unit 10, these also being disposed at positions approximately 30° to either side of the center of the apparatus.

The endmost elements 43 are connected to plate 44 by L-shaped brackets 80 secured to plate 44 by bolts 81 and having circular openings 82 through which are received shafts 84. Nuts 85 are screwed onto the opposite threaded ends of the shafts 84, and spacer sleeves 87 fix the spacings between the several spacer elements 43. At the lower side of the apparatus, the shafts **84*a* are elongated toward the left as shown in FIG. 1, and compression springs 89 disposed between the terminal element 43 and a washer 91 provide for expansion of the spacing between the lower elements 43** upon bending of the pipe.

The degree to which the apparatus must bend during bending of a pipe is very small. Bends in pipelines are generally of the order of about 1° per linear foot of pipe to 2° per linear foot of pipe. The plates 44 and 47 bend end-to-end to accommodate to the pipe bending curvature. The bolts 81 are somewhat loosely fitted so that they also will accommodate to the pipe bending curvature. Shaft 29 is loosely disposed in sleeves 51, so that these elements do not impede the apparatus as a whole from bending when pipe is bent.

Small plates 95 secured by screws 96 retain the pins 100 which connect the outer ends of toggle 36 to elements 43. As is best shown in FIG. 2, the inner side of each element 43 has plural slots 99 within which the toggle ends are received and secured by the pins 100. The elements 43 are provided with arcuately arranged angular surfaces 102 upon which the elongate plates 44 are secured by bolting or welding.

Referring now especially to FIGS. 1 and 3, the elements 43 closest to drive unit 10 have welded thereto a plurality of perforated brackets 105. Similar brackets 106 are welded to cover 12 of drive unit 10 opposite brackets 105. Plural toggle links 108 are connected between brackets 105, 106 by pins 109, 110. Toggles 108 permit inward and outward movements of the pipe engaging elements 45 yet substantially maintain the spacings between the pipe engaging elements and the drive unit.

When shafts 19 and 29 are extended by introduction of pressured hydraulic or pneumatic fluid into drive unit 10 through an appropriate fitting 112 to drive the shafts toward the left as seen in FIG. 1, the toggle elements 36 draw the pipe engaging elements 45 inwardly away from the pipe wall. When shaft 29 is moved toward the right as seen in FIG. 1 by introduction of pressured hydraulic fluid through inlet 114 of drive unit 10, the toggle elements 36 are moved toward their shown positions vertically disposed between elements 33 and 43, the pipe engaging elements 45 are forceably driven against the opposite sides of the pipe wall. In this position, the pipe wall engaging elements 45 serve to support the pipe wall during bending of the pipe. The bend will usually be made with the upper element 45 at the inside of the bend and with the lower element 45 at the outside of the bend. After a bend is made, the drive unit 10 is operated to again retract the pipe engagement elements 45, the wheels 66 providing for movement of the apparatus to the next bending location. The apparatus may then be expanded by another operation of drive unit 10 for bending a further length portion of the pipe, the procedure being repeated until the full bend is completed.

It will now be understood that the apparatus provided according to the invention is very simple in structure and operation, and provides a lightweight and simple apparatus for use in bending pipe. The force with which the pipe engaging elements 45 engage the pipe wall is very high, since the toggle elements in their movement toward their vertical positions approach infinite force.

While preferred embodiments of the apparatus have been described and shown in the drawings, many modifications thereof may be made by a person skilled in the art without departing from the spirit of the invention, and it is intended to protect by Letters Patent all forms of the invention falling within the scope of the following claims.

I claim:

1. Pipe bending mandrel apparatus for supporting the wall of a pipe during bending of the pipe, comprising drive means having a shaft means reciprocably movable axially of a pipe to be bent, a unitary elongate pipe engagement means disposed at each of opposite sides of said shaft means for engaging opposite sides of the wall of the pipe, first toggle means connecting each said pipe engagement means to said drive means and permitting inward and outward movements of said pipe engagement means, plural axially spaced second toggle means connecting each said pipe engagement means to said shaft means whereby said pipe engagement means are drawn inwardly toward said shaft means when said shaft means is moved axially in one direction and are forced outwardly against opposite sides of the pipe wall when said shaft means is moved axially in the other direction, each said pipe engagement means including plural parallel axially spaced first transverse bar means each having plural transversely aligned pivotal toggle end connections, said shaft means including plural parallel axially spaced second transverse bar means each having plural transversely aligned pivotal toggle end connections oppositely disposed at opposite sides thereof and being spaced along said shaft means by spacer sleeves disposed around said shaft means, said second toggle means each comprising plural parallel toggles each connected between toggle end connections of said first and second transverse bar means.

2. The combination of claim 1, said drive means comprising cylinder means, said shaft means comprising the shaft of said cylinder means and a longitudinal shaft axially aligned therewith and a connector body connecting said cylinder means shaft to said longitudinal shaft, said connector body connections to said shafts permitting limited pivotal movements between said shafts to accommodate bending movements between said drive means and the remainder of said apparatus.

3. The combination of claim 2, said shafts being pinned to said connector means by a pair of parallel pins.

4. The combination of claim 2, including sleeve means disposed around said longitudinal shaft spacing said second transverse bar means apart on said shaft.

5. The combination of claim 4, the terminal bar means of said first transverse bar means of each said pipe engagement means which are disposed at the end of said apparatus at which said drive means is disposed and said drive means each having plural transversely aligned toggle connection means, said first toggle means each comprising plural parallel toggles connected between said toggle connection means of each said terminal bar means and said drive means.

6. Pipe bending mandrel apparatus for supporting the wall of a pipe during bending of the pipe, comprising drive means having a shaft means reciprocably movable axially of a pipe to be bent, a unitary elongate pipe engagement means disposed at each of opposite sides of said shaft means for engaging opposite sides of the wall of the pipe, first toggle means connecting each said pipe engagement means to said drive means and permitting inward and outward movements of said pipe engagement means, plural axially spaced second toggle means connecting each said pipe engagement means to said shaft means whereby said pipe engagement means are drawn inwardly toward said shaft means when said shaft means is moved axially in one direction and are forced outwardly against opposite sides of the pipe wall when said shaft means is moved axially in the other direction, said shaft means having plural axially spaced toggle connection means therealong to which the inner ends of said second toggle means are connected, each said pipe engagement means having plural axially spaced toggle connection means affixed to its inner side to which the outer ends of said second toggle means are connected, said drive means comprising cylinder means, said shaft means comprising the shaft of said cylinder means and a longitudinal shaft axially aligned therewith and a connector body connecting said cylinder means shaft to said longitudinal shaft, said shafts being pinned to said connector means by a pair of parallel pins, said connector body connections to said shaft permitting limited pivotal movements between said shafts to accommodate bending movements between said drive means and the remainder of said apparatus, said toggle connection means affixed to each said pipe engagement means each comprising plural axially spaced connection bodies having connection shaft means disposed therethrough, spacer sleeves disposed around said connection shaft means between successive connection bodies, each said connection body having a plurality of laterally aligned slots each having the outer end of a said second toggle means pivotally connected therein.

7. The combination of claim 6, said plural axially spaced toggle connection means on said shaft means each comprising a body having an opening through which said longitudinal shaft extends and having oppositely disposed laterally aligned slots of said plurality each having the inner end of a said second toggle means pivotally connected therein.

8. The combination of claim 7, said second toggle means being connected to each said connection body and body by a single connection pin at each end of said second toggle means.

9. The combination of claim 8, the outer end of said longitudinal shaft extending beyond the said body disposed farthest from said drive means, plate means having an opening through which said outer end of said longitudinal shaft is disposed, a spacer sleeve disposed around said longitudinal shaft between said farthest body and said plate means, and retainer means affixed to said outer end of said longitudinal shaft.

10. The combination of claim 9, said connection shaft means disposed through said connection bodies of one of said pipe engagement means having an end portion extending beyond a terminal one of said connection bodies, a compression spring disposed around said end portion, and retainer means on the end of said portion retaining said compression spring in compression between said retainer means and said terminal one of said connection bodies, whereby said apparatus may bend to be passed through a bent length of pipe.

11. The combination of claim 10, said plate and at least one of said bodies being keyed against rotation about said longitudinal shaft.

12. The combination of claim 11, including wheel means carried by said drive means and by said plate for supporting said apparatus when said pipe engagement means are drawn toward said shaft means when said shaft means is moved axially in said one direction by said drive means.

* * * * *